US006216591B1

(12) United States Patent
Nanba

(10) Patent No.: US 6,216,591 B1
(45) Date of Patent: Apr. 17, 2001

(54) DELIVERY FAN IN A ROTARY PRINTING PRESS FOR DELIVERING SIGNATURES IN OVERLAPPING SUCCESSION

(75) Inventor: Takeo Nanba, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/524,691

(22) Filed: Mar. 14, 2000

(30) Foreign Application Priority Data

Apr. 9, 1999 (JP) ..... 11-102017

(51) Int. Cl.[7] ..... B41F 13/24; B65H 29/20
(52) U.S. Cl. ..... 101/232; 271/315
(58) Field of Search ..... 101/216, 232; 270/39.09, 58.26, 58.01, 60; 271/83, 187, 314, 315

(56) References Cited

U.S. PATENT DOCUMENTS 4,537,390 * 8/1985 Kiamco et al. ..... 270/60
4,729,554 * 3/1988 Honegger ..... 271/315
5,261,656 * 11/1993 Gutov et al. ..... 271/187
5,359,930 * 11/1994 Hansen ..... 101/232
5,975,525 * 11/1999 Hartmann et al. ..... 271/315

FOREIGN PATENT DOCUMENTS 61-2650 1/1986 (JP) .
11-21002 1/1999 (JP) .

* cited by examiner

*Primary Examiner*—Ren Yan
(74) *Attorney, Agent, or Firm*—Arent Fox Kintner Plotkin & Kahn

(57) ABSTRACT

A delivery fan used in a rotary printing press receives signatures from a folding machine and deposits them on a delivery conveyor and includes hub means, a plurality of fingers mounted to the hub means and a plurality of flat springs anchored to the hub means. The delivery fan handles signatures of varying thicknesses and prevents the signatures from jumping out of pockets formed by the fingers.

3 Claims, 4 Drawing Sheets

DELIVERY FAN IN A ROTARY PRINTING PRESS FOR DELIVERING SIGNATURES IN OVERLAPPING SUCCESSION

BACKGROUND OF THE INVENTION

This invention relates to a delivery fan suitable for use in, among other applications, in rotary printing presses for receiving signatures (i.e. sets of printed and folded sheets forming sections in newspaper production or book work) from a folding and cutting mechanism and depositing the signatures on a delivery conveyor or conveyor system in such a way that one signature laps over another.

In web-fed rotary printing presses, as commonly known, the webs of paper that have been printed in the printing sections are fed to the folding and cutting means whereby the webs are folded longitudinally and cut transversely into signatures of multiple pages. Disposed just downstream of the folding and cutting mechanism is a delivery fan constituting the subject of the instant invention. Typically, the delivery fan takes the form of a cylindrical rotor with a multiplicity of angled fingers or blades thereon defining pockets all equidistantly spaced one from another circumferentially of the rotor. As the rotor rotates at high speed, the signatures issuing from the folding and cutting mechanism are directed into the successive pockets and, subsequently stripped off the fingers, placed upon an underlying delivery conveyor in a neatly overlapping series.

There has been a problem, not yet totally overcome, in connection with the delivery fan of the foregoing general construction: how to prevent the signatures from rebounding and jumping out the pockets on hitting their bottoms. Japanese Unexamined Patent Publication No. 61-2650 represents one solution to that problem, suggesting lever arms that are pivotably pinned to the rotor to which the fingers are anchored providing the pockets for receiving the signatures. The lever arms extend outwardly from the rotor, one into each pocket, and are angled toward the pocket bottoms. A helical tension spring acts between the rotor and each lever arm, urging the latter against one of the fingers, so that the pockets are normally blocked by the lever arms in the neighborhood of their bottoms.

Emerging at high speed from the folding and cutting mechanism, the signatures are slid into the successive pockets of the underlying rotor as the latter rotates at a matching speed. Near the bottoms of the pockets the signatures will engage the lever arms and slide past them, causing pivotal displacement thereof against the bias of the tension springs, until they are fully received in the pockets. The spring-loaded lever arms function to brake the signatures into a soft stop against the pocket bottom, instead of allowing them to hit hard against the pocket bottom and hence fall off the pockets.

A first objection to this prior art device arises from the fact that the signatures to be handled might have several different number of pages (e.g. 4, 8, 16, or 32 pages in the case of newspaper production) and therefore of correspondingly different thicknesses. Moreover, the less the number of pages is, the more pliant are the signatures.

Suppose that the lever arms are sufficiently spring loaded to brake relatively thick signatures. Then the thinner signatures are prone to fail forcing their way fully into the pockets in opposition to the spring bias. Being so pliant, they have been easy to yield upon hitting the lever arms and so to be deformed or damaged along their edges. Or, being so light in weight, they tend to jump upwardly thereby hitting the lever arms and, upon falling down again, they get caught between the lever arms and the fingers. The result in the second instance has been irregularities in the pitch of the lapping series of signatures on the delivery conveyor.

Use of tension springs that can readily yield under the force of thin signatures would represent no fundamental remedy to this inconvenience. Such springs would be incapable of sufficiently braking thicker signatures, thereby allowing them to hit the pocket bottoms so hard as to ruin their edges, or to jump upwardly in the pockets thereby causing irregularities in the pitch of the overlapping signatures on the delivery conveyor.

Another objection concerns the mechanical construction comprising the pivotal lever arms and the helical tension springs. The pinned and spring-loaded lever arms are not so simple and inexpensive in construction as can be desired, because of the many component parts required, including the lever arms having a complex shape. Further this prior art device has been troublesome and time-consuming in assemblage, susceptible to trouble, and difficult to repair.

Japanese Unexamined Patent Publication No. 11-21002 teaches shock absorbers such as pieces of rubber or elastomeric material at the bottoms of the pockets in order to mitigate the impact of the signatures hitting the pocket bottoms. The pockets themselves are wide enough to receive the thickest signatures to be handled, so that the signatures of all different page numbers are allowed unrestricted into the pockets until they bottom against the shock absorbers and brakes.

This second prior art device is objectionable because of too much play is given in the pockets give for the thin signatures in their thickness direction. Such signatures are therefore easy to be displaced or deformed in the pockets, due in part to the centrifugal forces exerted thereon with the rotation of the delivery fan. The results has again been the disarrangement of the signatures on the delivery conveyor.

A third prior art device is cited as prior art in Japanese Unexamined Patent Publication No. 11-21002, supra, teaching a "spring steel stop" at the bottom of each pocket. Each stop is self-biased into abutment against a downstream one, with respect to the direction of fan rotation, of the fingers defining each pocket. Therefore, as in the case of the first cited prior art device, the stops may not necessarily yield to thin, pliant signatures, possibly deforming them or causing them to jump upwardly in the pockets with the consequent signature disarrangement on the delivery conveyor.

Such inconveniences will not likely occur with thicker signatures, which by virtue of their greater masses and kinetic energies will deflect the spring stops and wedge in between the stops and the fingers. This time, however, by reason of their thickness, the signatures may not smoothly disengage with the spring stops failing to align themselves neatly on the delivery conveyor.

SUMMARY OF THE INVENTION

It is therefore an object of this invention to make a simpler, less expensive, and easier to manufacture and assemble means for braking the signatures to a shockless stop as they enter the pockets of a delivery fan in a rotary printing press.

Another object of the invention is to make the delivery fan capable of handling signatures of different pages equally well, from the thickest to the thinnest signatures that are produced by rotary printing presses of the kind under consideration.

Briefly, the present invention may be summarized as a delivery fan suitable for use in a rotary printing press, among other applications, for receiving signatures from a folding and cutting mechanism and depositing the same on a delivery conveyor in an overlapping series. The delivery fan comprises a plurality of fingers mounted to a hub means, which is mounted on a rotational axis rotatable in a prescribed direction, and arcuately extending therefrom both outwardly and upstream of the hub means with respect to the prescribed rotational direction thereof. The fingers are constantly spaced from one another circumferentially of the hub means, with every two neighboring fingers defining a pocket for receiving a signature. The invention particularly features a plurality of flat springs with each anchored to the hub means and with each extending toward a bottom of one pocket in order to prevent the signatures from jumping out the pockets. There is a spacing, which is, at least in part, only somewhat less than the known least thickness of signatures to be handled, between each flat spring and a downstream one, with respect to the prescribed rotational direction of the hub means, of each circumferentially spaced pair of fingers defining a part of one pocket.

Preferably, each flat spring has one end portion anchored to the hub means, a midportion extending past one end of one finger toward another finger which is located downstream of the one finger with respect to the prescribed rotational direction of the hub means, so as to provide a space wedgeshaped toward the bottom of the pocket between the midportion and the another finger, and a free end portion extending substantially parallel to the other finger with the noted spacing therebetween which is less than the least thickness of signatures to be handled.

Ejected at high speed from the folding and cutting means, the signatures are guided one after another into the successive pockets between the fingers on the hub means rotating at a speed matching the rate the signatures are supplied. In each pocket the signature will force its way between the flat springs and the fingers down to the bottoms of the pockets. The wedgeshaped spaces between the midportions of the flat springs and the fingers are intended to assure smooth entrance of the signatures between the springs and the fingers.

The flat springs will deflect to varying degrees depending in part upon the number of pages, and hence the thickness, of the signatures and correspondingly react thereon. The thicker the signatures are, the greater will be the forces with which the springs react to brake them. Signatures of all the pages, and all the thicknesses, will be infallibly caught by the flat springs as they enter the pockets at high speed, and thereby braked in the pockets, hitting the pocket bottoms with so little impact as to stay thereon without inconveniently rebounding.

It is to be noted that unlike the prior art "spring steel stops" cited above, the flat springs are not normally held against the fingers but spaced therefrom a distance just slightly less than the minimum thickness of signatures to be handled. Consequently, even such thinnest signatures will be smoothly admitted into the pockets and braked to a stop on their bottoms. The signatures of the minimum thickness and all the other possible thicknesses will thus be deposited on the underlying delivery conveyor in a neatly overlapping series, without irregularities in pitch or orientation.

As an additional advantage, with each anchored at one end only and having another end spaced from the fingers, the flat springs according to the instant invention can be of greater rigidity than the conventional spring stops. The flat springs are high in durability, thereby not being easily permanently deformed in use.

Attention should also be paid to the simplified mechanical design of the braking means because all that is required are leaf springs, preferably each one being in the form of a simple, preformed strip of spring material, and fastener means for anchoring them to the hub means with each at one end. The manufacturing and assembling costs of such braking means are literally at a minimum. Also, because of their simplicity, the braking means according to the invention will operate with minimum trouble throughout the expected lifetime of the delivery fan, and even if trouble does occur, repair will be easy.

The above and other objects, features and advantages of this invention and the manner of achieving them will become more apparent, and the invention itself will best be understood, from a study of the following description and attached claims, with reference to the accompanying drawings showing a preferred embodiment of the invention.

DESCRIPTION OF THE PREFERRED EMBODIMENT

The delivery fan according to this invention will now be described in detail as adapted specifically for use in a web-fed rotary printing press having a plurality of printing sections capable of concurrently printing on separate webs of paper or the like. The printed webs are superposed one upon another, and folded longitudinally and cut transversely into signatures of any of several different standard number of pages. The signatures are supplied from the folding and cutting mechanism to the delivery fan, thereby to be successively placed on a delivery conveyor system into an overlapping series.

Figure 1:
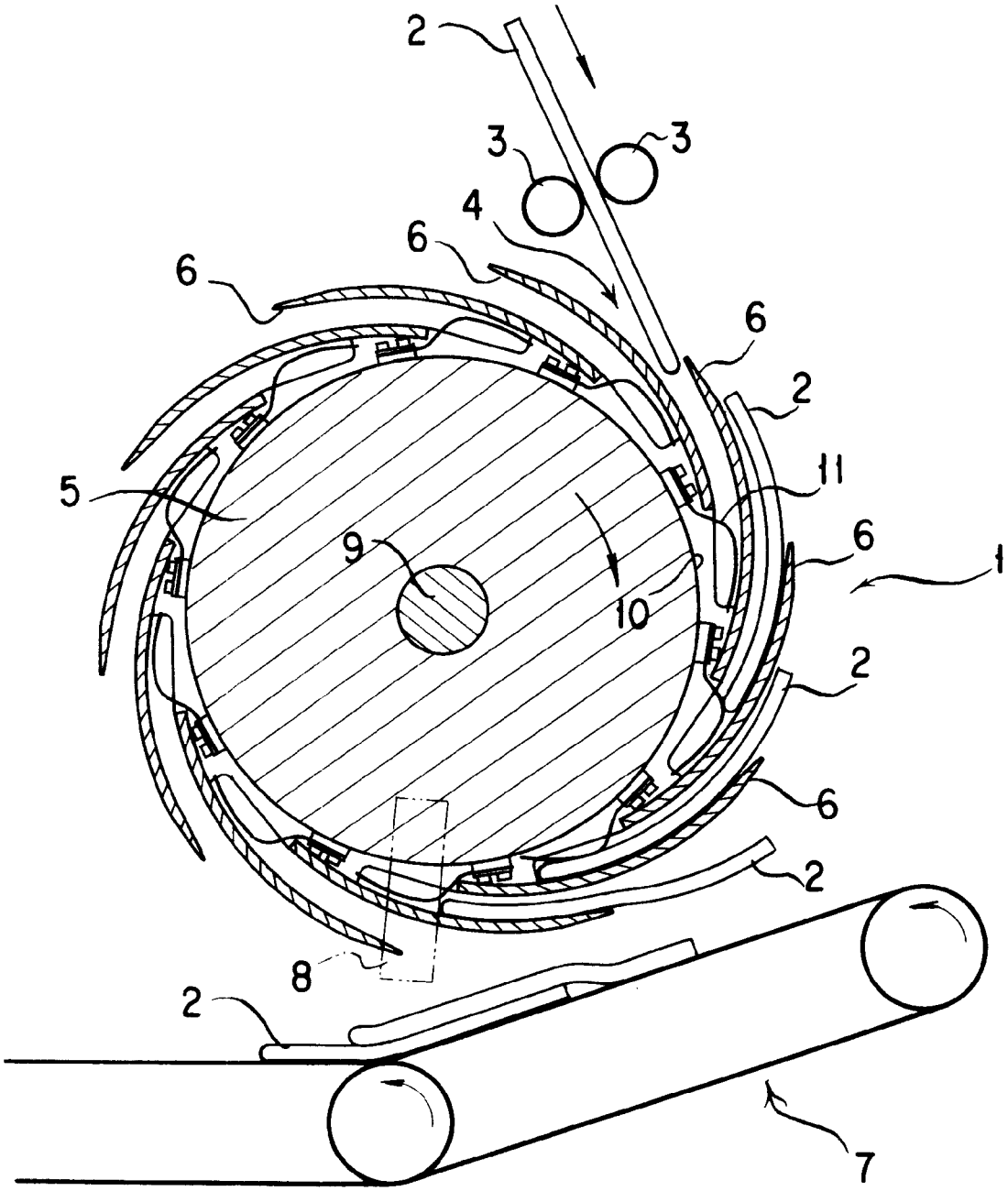
FIG. 1 is a vertical section view of the signature delivery fan embodying the principles of the invention, shown together with the signatures entering the fan pockets and subsequently deposited on a delivery conveyor system in an overlapping series.

Generally labeled 1 in FIG. 1, the delivery fan embodying the principles of this invention is shown receiving signatures 2 as they are fed at high speed from the folding and cutting mechanism, not shown, via a pair of feed rollers 3. After being caught instantaneously by the delivery fan, the signatures 2 are to be successively released therefrom by fixed stripper bars 8. So released, the signatures will fall on an underlying delivery conveyor system 7 in a neatly overlapping series, thereby to be conveyed to a place of shipment.

Figure 2:
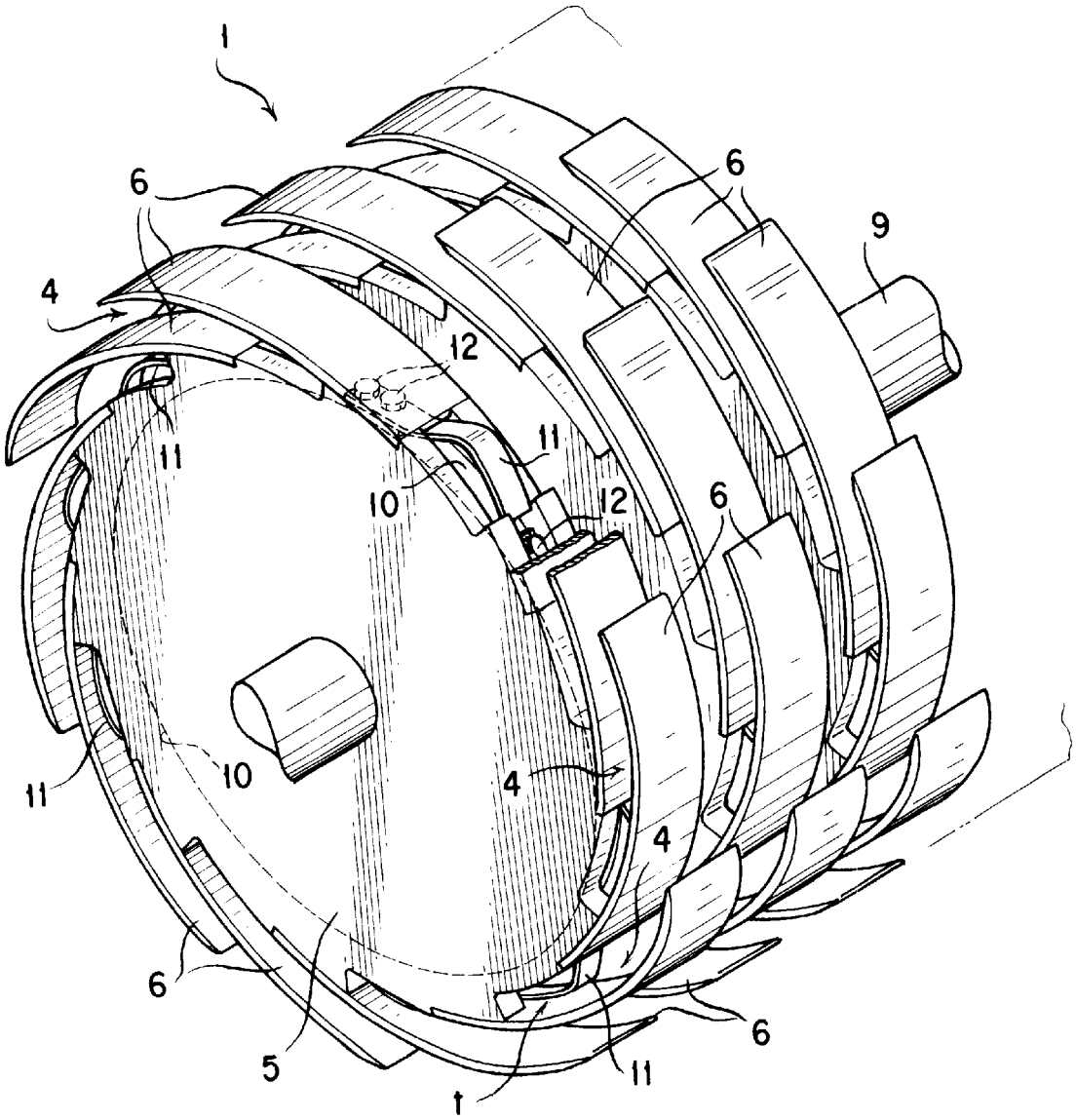
FIG. 2 is an enlarged, perspective, fragmentary view, with parts shown broken away to reveal other parts, of the signature delivery fan.

As will be understood from both FIGS. 1 and 2, the delivery fan 1 has a plurality of disklike hubs 5 mounted coaxially on a drive shaft 9 at constant axial spacings. The drive shaft 9 is coupled to drive means, not shown, whereby it is rotated in a predetermined direction, clockwise as viewed in FIG. 1, at a speed matching the rate at which the signatures 2 are supplied from the folding and cutting mechanism.

A plurality of, ten, in the illustrated embodiment, fingers 6 are affixed each at one end to each hub 5 and arcuately extend therefrom both outwardly and upstream, with respect to the predetermined direction of hub rotation, of the hubs. Each in the form of a strip of rigid material with a width approximately equal to that of each hub 5, the fingers 6 are constantly spaced from one another circumferentially of each hub. Further the fingers 6 on all the hubs 5 are in phase; that is, the fingers are arranged on the hubs in rows extending parallel to the hub axis, besides being aligned circumferentially of the hubs.

Pockets 4 are thus defined by and between the rows of fingers 6. It will be seen that the pockets 4 extend parallel to the axis of the hubs 5, or to the drive shaft 9, and are constantly spaced from one another circumferentially of the hubs. Each pocket 4 is sufficiently wide to receive with appropriate clearance the signatures of the greatest number of pages to be produced by the printing press.

As best revealed by FIG. 2, an annular groove 10 is cut in the surface of each hub 5. A series of flat springs 11 are mounted in the groove 10 in each hub 5 at the same circumferential spacings as the fingers 6. In the shape of a strip of spring material, and narrower than each groove 10, each flat spring 11 is anchored to one hub 5 and extends across one pocket 4 and toward its bottom in order to prevent the signatures 2 from jumping out the pockets.

Figure 3:
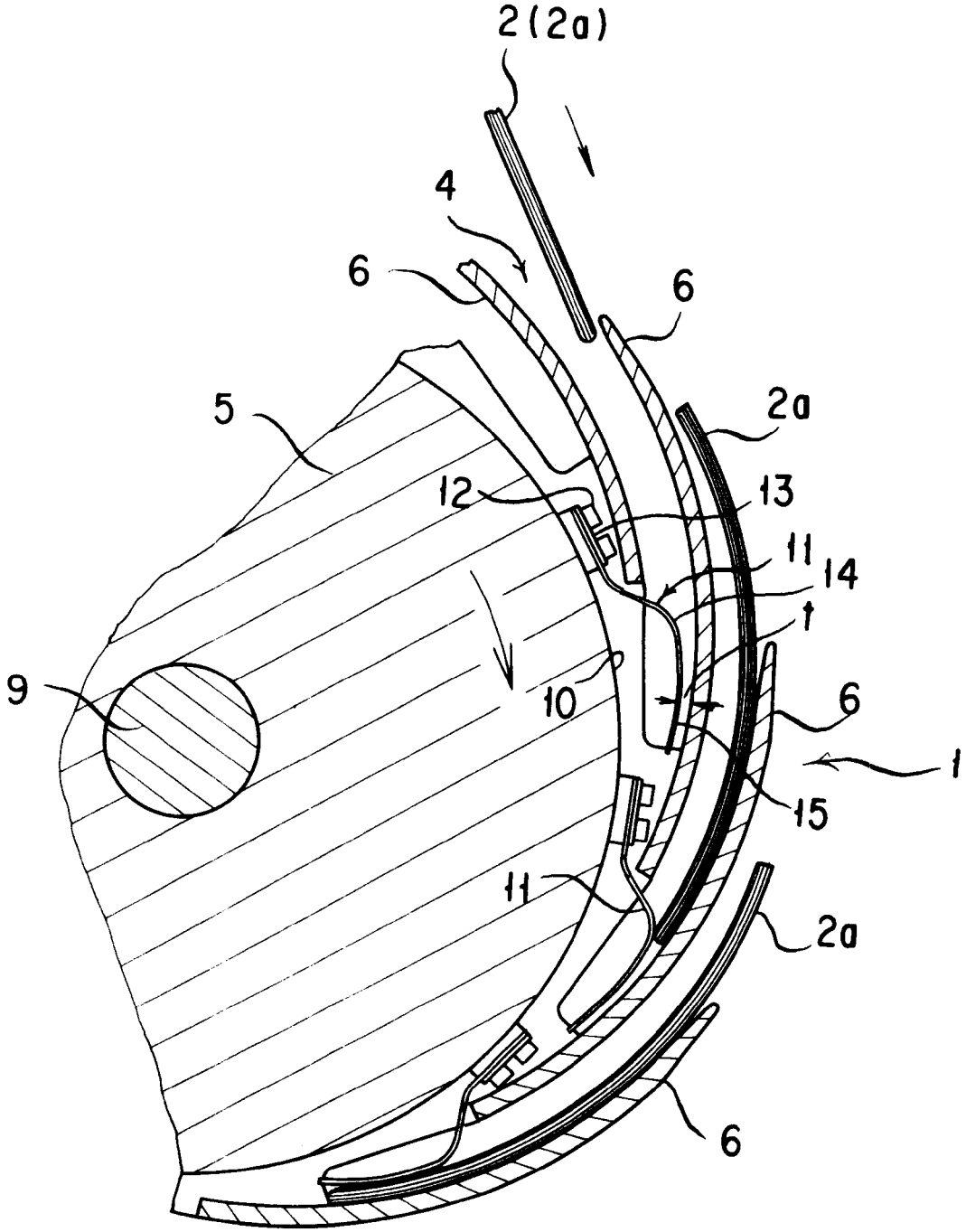
FIG. 3 is an enlarged, fragmentary sectional view similar to FIG. 1 but explanatory of how thin signatures are braked in the fan pockets.
Figure 4:
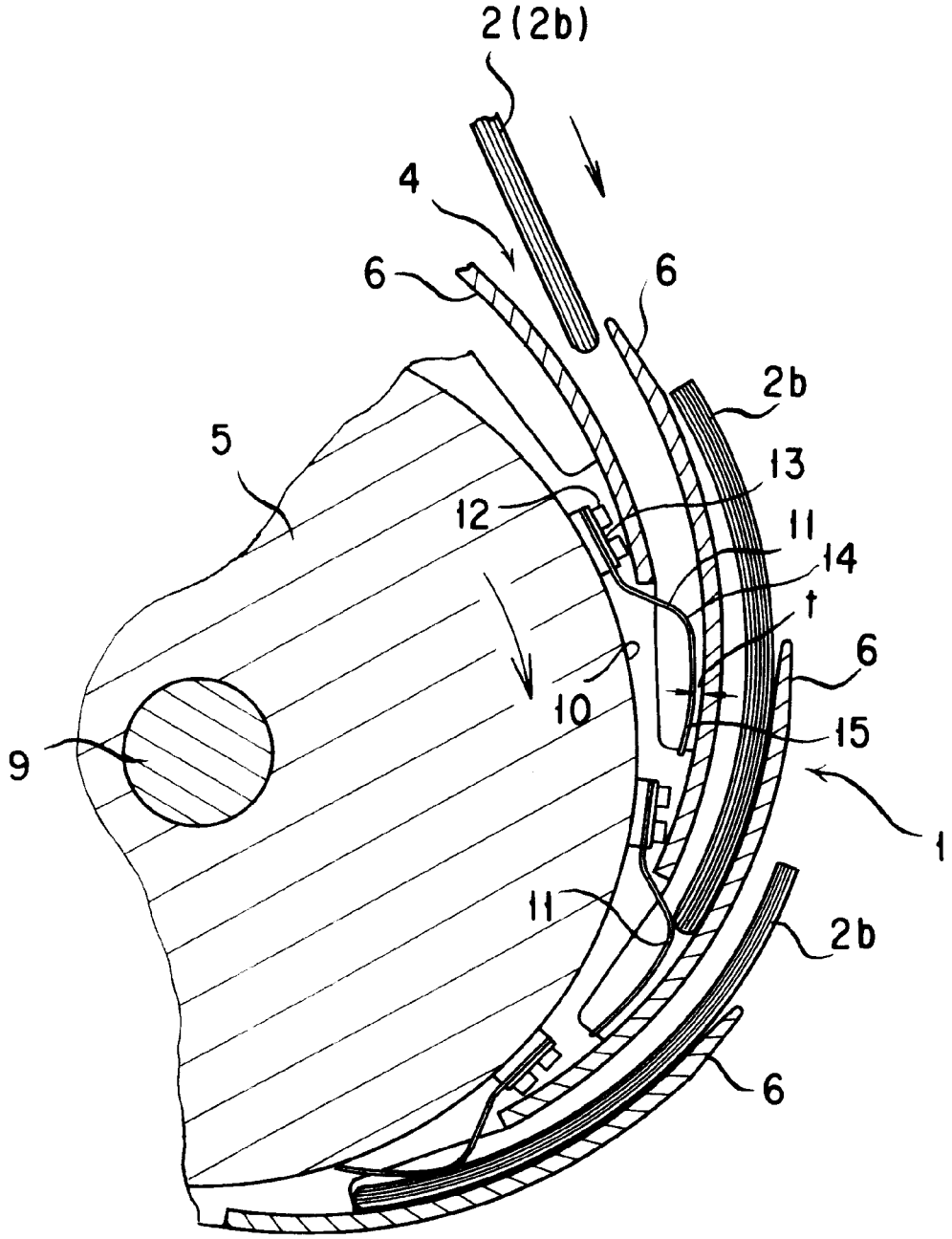
FIG. 4 is a view similar to FIG. 3 but explanatory of how thick signatures are braked in the fan pockets.

More specifically, as indicated in FIGS. 3 and 4, each flat spring 11 is preformed to include a fixed end portion 13 screwed at 12 to the hub 5, a midportion 14 extending past the inner, anchored end of one finger toward another finger which is located downstream of the first recited finger with respect to the arrow-marked rotational direction of the delivery fan 1, and a free end portion 15 extending approximately parallel to the second recited finger.

Extending as above from the inner end of the first finger approximately toward the longitudinal midpoint of the second finger, the midportion 14 of each flat spring 11 is angled with respect to the second finger to provide a space wedge-shaped toward the bottom of the pocket between the midportion and the first finger. It will also be noted from FIG. 3 that the free end portion 15 of each flat spring 11 is not held against the second finger but spaced therefrom a spacing t that is slightly less than the known thickness of least page signatures to be produced by the printing press.

Operation

Since signatures to be handled by the delivery fan 1 come in several different standard number of pages and correspondingly different thicknesses, it is considered necessary that the functionings of the flat springs 11 be studied in two separate cases of handling relatively thin signatures 2*a* as in FIG. 3 and relatively thick signatures 2*b* as in FIG. 4.

With reference first to FIG. 3, emerging at high speed from between the pair of feed rollers 3, each thin signature 2*a* will enter one pocket 4 between two circumferentially neighboring rows of fingers 6 of the delivery fan 1 rotating clockwise at a constant speed matching the rate of supply of the signatures. In each pocket 4 the thin signature 2*a* will travel along the surfaces of the downstream side fingers 6, with respect to the direction of fan rotation, of the pocket. Then the thin signature 2*a* will enter the wedgeshaped spaces between the midportions 14 of the flat springs 11 and the downstream side fingers 6, thereby to be guided into the narrow spacings t between the free end portions 15 of the flat springs 11 and the downstream side fingers 6. Then the thin signature 2*a* will arrive at the bottom of the pocket 4 like the lowermost signature of FIG. 3.

Even the thinnest signatures will not jump up, let alone fall off, on hitting the flat springs 11 in the pockets 4 by virtue of the spacing t between the free end portions 15 of the springs and the fingers 6. The tapering spaces between fingers 6 and spring midportions 14 are designed to assure smooth introduction of the signatures into the reduced spacings t.

Although the flat spring free end portions 15 are held spaced from the downstream side fingers 6 for the foregoing reasons, nevertheless the spacing t is made less than the thickness of the least pages signatures to be produced by the press. Therefore, upon engagement of the thin signature 2*a* between fingers 6 and flat springs 11, these springs will deflect to an extent determined by the thickness of that signature. By reaction, then, the springs will relatively lightly brake the thin, and therefore lightweight, signature, thereby mitigating the impact of the signature hitting the pocket bottom and so preventing the same from rebounding.

Referring now to FIG. 4, the thick signatures 2*b* will be admitted into the successive pockets 4 through the same process as are the thin signatures 2*a*, except for the angle of deflection of the flat springs 11 upon engagement of each such signature between downstream side fingers 6 and flat spring free end portions 15. Although the thick signatures 2*b* may be much thicker than the spacing t between fingers 6 and flat spring free end portions 15, each such signature by its greater mass and kinetic energy will force itself into the spacing t thereby causing the flat springs 11 to deflect through greater angles than in the case of the thin signatures 2*a*. So deflected, the flat springs 11 will exert correspondingly greater braking forces on the thick signatures 2*b* and so alleviate the impact of the signatures hitting the pocket bottoms, preventing them from rebounding just as in the case of the thin signatures 2*a*.

Thus, the thicker the signatures are, the greater will be the braking forces applied thereto by the flat springs 11. Subsequently carried down onto the delivery conveyor system 7, FIG. 1, with the rotation of the delivery fan 1, the signatures 2*a* or 2*b* will be successively deposited thereon in an overlapping series by butting against the stripper bars 8 interposed with the hubs 5. The signatures will be neatly aligned on the conveyor system as they have all been fully bottomed in the fan pockets.

Although the spacing t between the free end portions 15 of the flat springs 11 and the fingers 6 are meant principally for engagement of thin signatures therebetween, this configuration yields an additional advantage: The flat springs can be of greater rigidity than if, as in the prior art device set forth earlier, they were held against the fingers. Such rigid springs will suffer less permanent strain from cyclic stress and so offer a longer useful life.

Although the present invention has been hereinbefore described very specifically, it is not desired that the invention be limited by the exact details of this disclosure. A variety of modifications and alterations of the illustrated embodiment may be made in order to conform to design preferences or to the requirements of each specific application without departing from the proper scope or fair meaning of the claims which follow.

What is claimed is:

1. A delivery fan suitable for use in a rotary printing press, among other applications, for receiving signatures from a folding mechanism and depositing the same on a delivery conveyor in an overlapping succession, the delivery fan being capable of handling signatures of different number of pages and thicknesses including those of a known least thickness, comprising:

(a) hub means mounted on a rotational axis rotatable in a prescribed direction;

(b) a plurality of fingers mounted to the hub means and arcuately extending therefrom both outwardly and upstream of the hub means with respect to the prescribed rotational direction thereof, the fingers being spaced from one another circumferentially of the hub means, every two neighboring fingers defining a pocket for receiving a signature; and (c) a plurality of flat springs anchored to the hub means and each extending toward a bottom of one pocket in order to prevent the signatures from jumping out the pockets, there being a spacing, which is at least in part less than the known least thickness of signatures to be handled, between each flat spring and a downstream one, with respect to the prescribed rotational direction of the hub means, of each circumferentially spaced pair of fingers defining part of one pocket.

2. The delivery fan of claim 1 wherein each flat spring has a midportion extending from one finger toward another finger so as to provide a space wedgeshaped toward the bottom of the pocket between the midportion and the another finger.

3. The delivery fan of claim 1 wherein each finger has one end affixed to the hub means, and wherein each flat spring has a fixed end portion anchored to the hub means, a midportion extending past said one end of one finger toward another finger which is located downstream of said one finger with respect to the prescribed rotational direction of the hub means, so as to provide a space wedgeshaped toward the bottom of the pocket between the midportion and the another finger, and a free end portion extending substantially parallel to said other finger with a spacing therebetween which is less than the known least thickness of signatures to be handled.

* * * * *